US005528778A

United States Patent [19]

Shrock et al.

[11] Patent Number: 5,528,778

[45] Date of Patent: Jun. 25, 1996

[54] SEAT-BED ASSEMBLY

[75] Inventors: Fred J. Shrock; John D. Shimkus; Scott J. Shrock; Robert L. Fisher, all of Elkhart, Ind.

[73] Assignee: Shrock Manufacturing, Inc., Elkhart, Ind.

[21] Appl. No.: 263,463

[22] Filed: Jun. 22, 1994

[51] Int. Cl.[6] ..... A47C 17/17

[52] U.S. Cl. ..... 5/37.1; 5/47

[58] Field of Search ..... 5/37.1, 47, 17, 5/18.1, 44.1

[56] References Cited

U.S. PATENT DOCUMENTS

| | | | |
|---|---|---|---|
| 4,321,716 | 3/1982 | Shrock | 5/37.1 |
| 4,563,784 | 1/1986 | Shrock et al. | 5/37.1 |
| 4,756,034 | 7/1988 | Stewart | 5/37.1 |

*Primary Examiner*—Alexander Grosz
*Attorney, Agent, or Firm*—Baker & Daniels

[57] ABSTRACT

The invention is directed to a seat-bed assembly movable between a seat position and a bed position, and including a seat support, a back support, and a frame having a horizontal support member. A plurality of links, including a first link and a second link, interconnect the seat support and the back support with the frame. The links support the seat support and the back support for movement between the seat position and the bed position. Each of the first link and the second link have one end thereof with an opening therein. The horizontal support member has an upper surface and includes two side plates. An elongated opening extends downwardly from the upper surface. Each side plate has a first guide channel associated with the first link and a second guide channel associated with the second link. A first pin extends through the first link opening and each first guide channel, and a second pin extends through the second link opening and each second guide channel.

14 Claims, 6 Drawing Sheets

SEAT-BED ASSEMBLY

BACKGROUND OF THE INVENTION

1. Field of the Invention

The present invention relates to seat-bed assemblies, and, more particularly, to seat-bed assemblies mounted in a motor vehicle.

2. Description of the Related Art

Seat-bed assemblies having a seat support and a back support which may be moved from a seat position to a bed position are known in the art. For example, my earlier U.S. Pat. Nos. 4,321,716 and 4,563,784, disclose manually operated and power actuated seat-bed assemblies, respectively. With such known devices a horizontal support extends between upright support members. The horizontal support comprises a plate-like structure and includes a pair of guide channels comprising slots cut into the horizontal support. A linkage structure includes a first link which interconnects one of the guide channels with a seat support, and a second link which interconnects the other of the guide channels with a back support. To connect the first and second links with the respective guide channels, a pair of pins or the like extends through each respective guide channel and an opening formed in each of the first and second links. The first and second links are thus disposed adjacent to the guide channels and along one side of the horizontal support.

Although a step forward in the art, a problem with such designs is that when a forward or rearward force is applied to the back support (and thus the linkage structure interconnecting the horizontal support with the back support), a twisting moment is exerted on the link at the point of connection to the guide channel because the link is disposed to the side of the horizontal support. Such twisting may in turn cause bending or bowing of the link which results in a decreased ability to withstand the forward or rearward force. Additionally, the shear force applied to the pin interconnecting the link and guide channel is relatively high because the pin is only connected to the guide channel at one location.

Another problem is that the linkage structure, seat support and especially the back support may be movable relative to each other in a sideways direction.

A still further problem is that the cushions overlying the seat support and back support interfere with each other when the seat-bed assembly is moved from the seat position to the bed position, or vice versa. To wit, when the seat-bed assembly is in the seat position, it is desirable to have the cushions overlying the seat support and the back support disposed closely adjacent to each other. However, with known structures, the guide channels comprise straight slots formed in the horizontal support. When the seat begins movement from the seat position to the bed position, the rear edge of the seat support travels in an upward and forward direction, while the bottom edge of the back support travels in a downward and forward direction. The movement of the seat support in an upwards direction and the back support in a downwards direction causes the seat cushion and back cushion to contact and interfere with each other. Such interference makes movement from the seat position to the bed position more difficult. A similar problem occurs when the seat-bed assembly is moved from the bed to the seat position.

Yet another problem is that the linkage structure may contact and thereby damage upholstery or surfaces of the seat-bed assembly. For example, a link may extend through a front surface of the seat-bed assembly. However, for aesthetic purposes, it may be desirable to attach an upholstered panel to the front surface of the seat-bed assembly. If the link extends through the front surface of the seat-bed assembly, it may be necessary to cut through the upholstered panel to allow the link to extend therethrough. The opening decreases the aesthetic appeal of the seat-bed assembly, and adds to the cost.

A further problem is that with conventional designs, the back support directly engages the frame when the seat-bed assembly is in the bed position. Since the back support is usually upholstered on the back surface as well as the front surface thereof, the upholstery engaging the frame may become worn and damaged.

SUMMARY OF THE INVENTION

The present invention provides a seat-bed assembly including a frame for carrying a seat support and back support, providing increased strength when forward or rearward forces are applied to the back support, and inhibiting transverse movement of the seat support and back support.

The invention comprises, in one form thereof, a seat-bed assembly movable between a seat position and a bed position. The seat-bed assembly includes a seat support, a back support, and a frame having a horizontal support member. A plurality of links, including a first link and a second link, interconnect the seat support and the back support with the frame. The links support the seat support and the back support for movement between the seat position and the bed position. Each of the first link and the second link have one end thereof with an opening therein. The horizontal support member has an upper surface and includes two side plates. An elongated opening extends downwardly from the upper surface. Each side plate has a first guide channel associated with the first link and a second guide channel associated with the second link. A first pin extends through the first link opening and each first guide channel, and a second pin extends through the second link opening and each second guide channel.

An advantage of the present invention is that deformation of structural elements of the seat-bed assembly is inhibited during application of forces to the back support.

Another advantage is that side-to-side movement of the seat support and back support is inhibited.

Yet another advantage is that the seat-bed assembly may be maintained in the bed position without the bottom of the back support resting on the frame.

A further advantage is that a positive stop is provided to inhibit movement of the back support in a rearward direction when the seat-bed assembly is in the seat position.

A still further advantage is that the seat-bed assembly may be mowed from the seat position to the bed position, or vice versa, without increasing a relative spacing between adjacent edges of the back support and seat support.

Also, dual angled tracks create controlled spacing between seat and back cushions.

Yet a further advantage is that a seat-bed assembly may be provided having a vertical front surface, and wherein the seat-bed assembly may be moved from the seat position to the bed position, or vice versa, without any linkage structure extending through the front surface.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
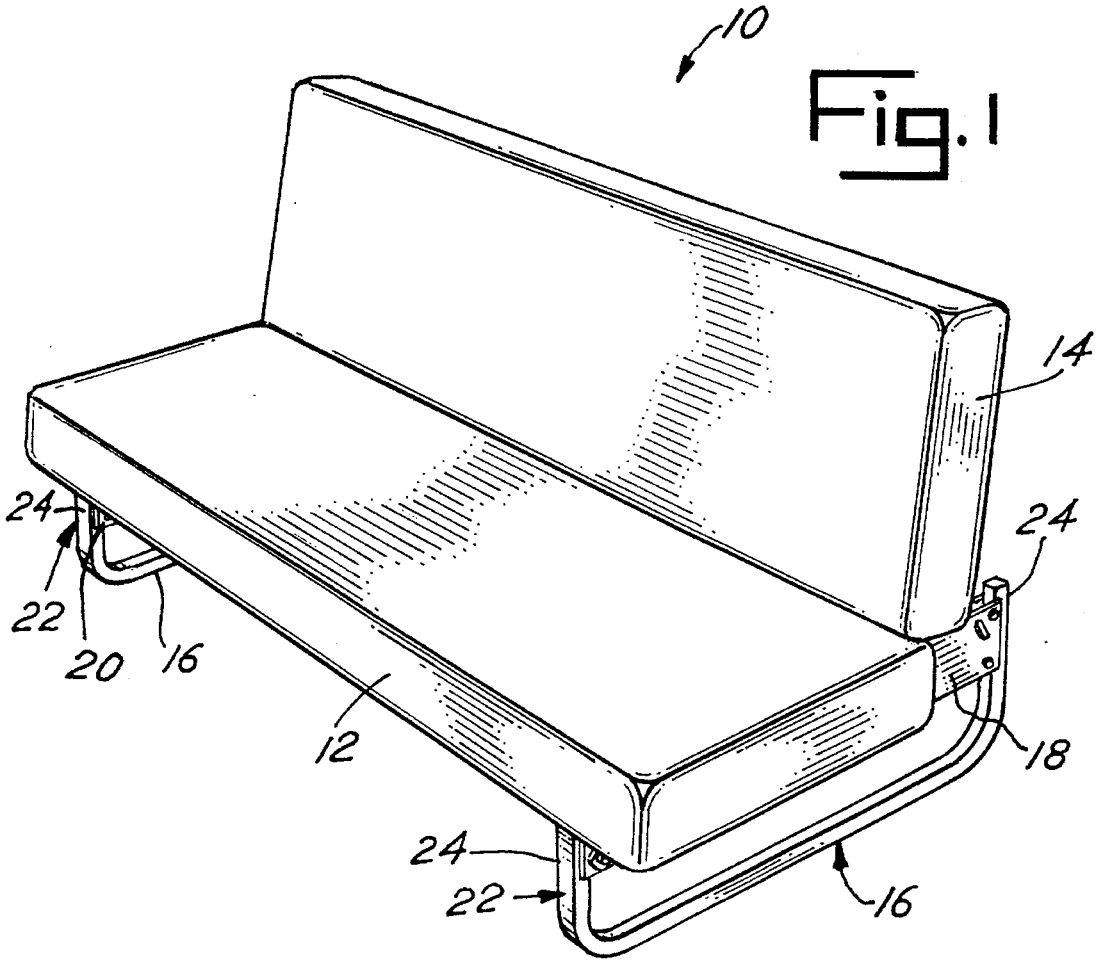
FIG. 1 is a perspective view of an embodiment of the seat-bed assembly of the present invention in the seat position.
Figure 2:
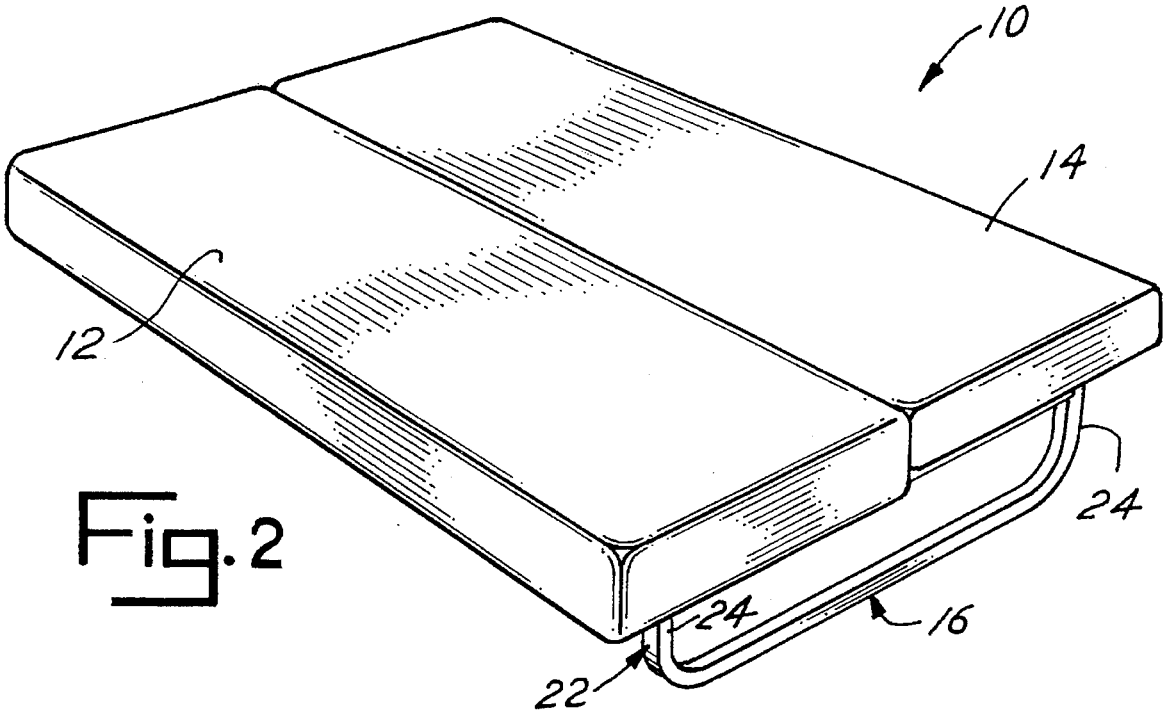
FIG. 2 is a perspective view of the seat-bed assembly of FIG. 1 in the bed position.

Referring now to the drawings and particularly to FIGS. 1 and 2, there is shown a seat-bed assembly 10 of the present invention, including seat 12 and back 14 carried by frame 16. FIG. 1 illustrates seat-bed assembly 10 in a seat position, and FIG. 2 illustrates seat-bed assembly 10 in a bed position.

Frame 16 includes two horizontal support members 18, 20 disposed at respective ends of seats 12 and back 14. Each of horizontal support members 18, 20 are attached at each end thereof to a vertical support member, three of which are shown and referenced 22, 24 and 26 in FIGS. 1 and 2.

Figure 3:
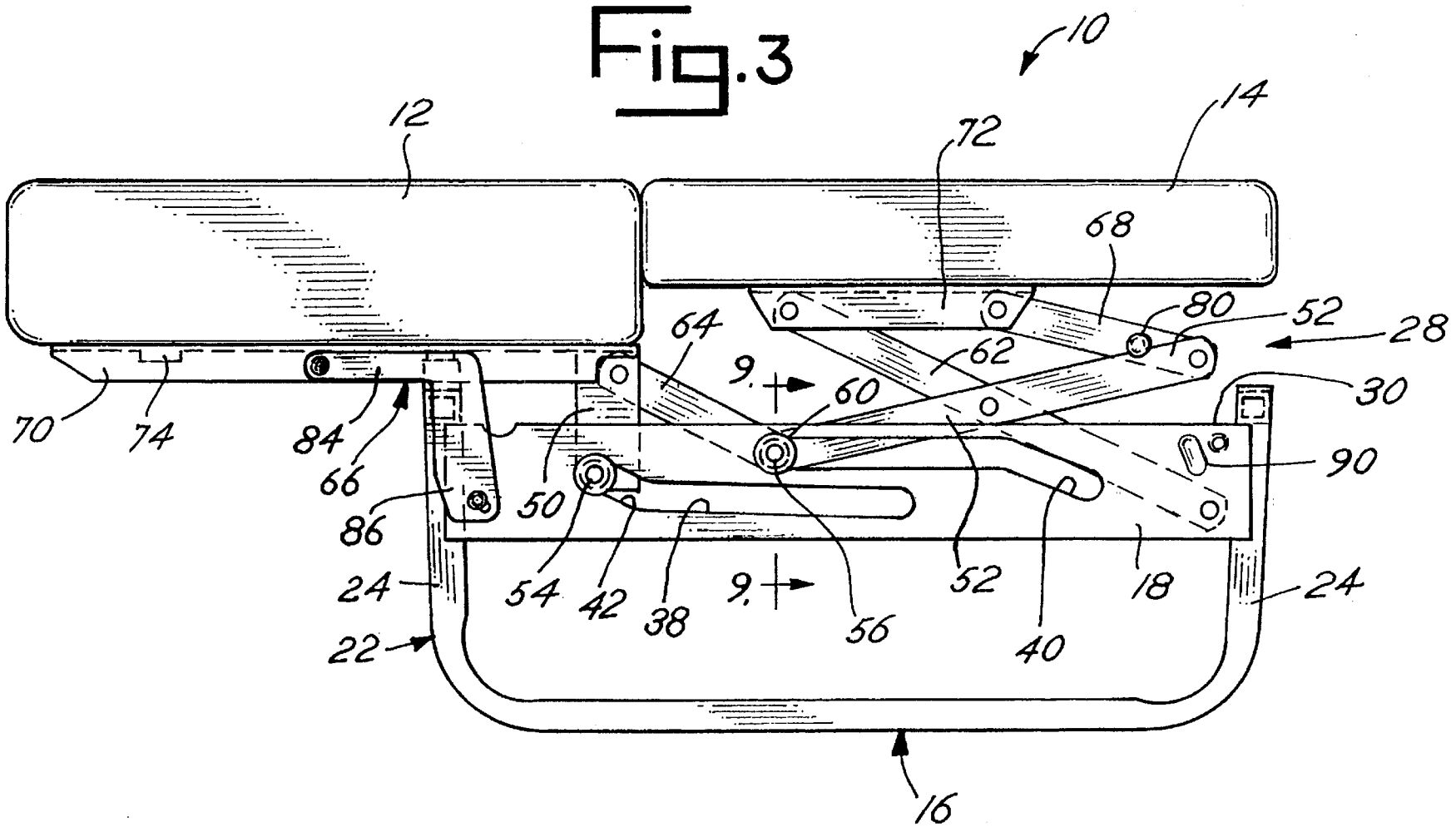
FIG. 3 is a side elevational view of the seat-bed assembly of FIGS. 1 and 2 in the bed position.
Figure 4:
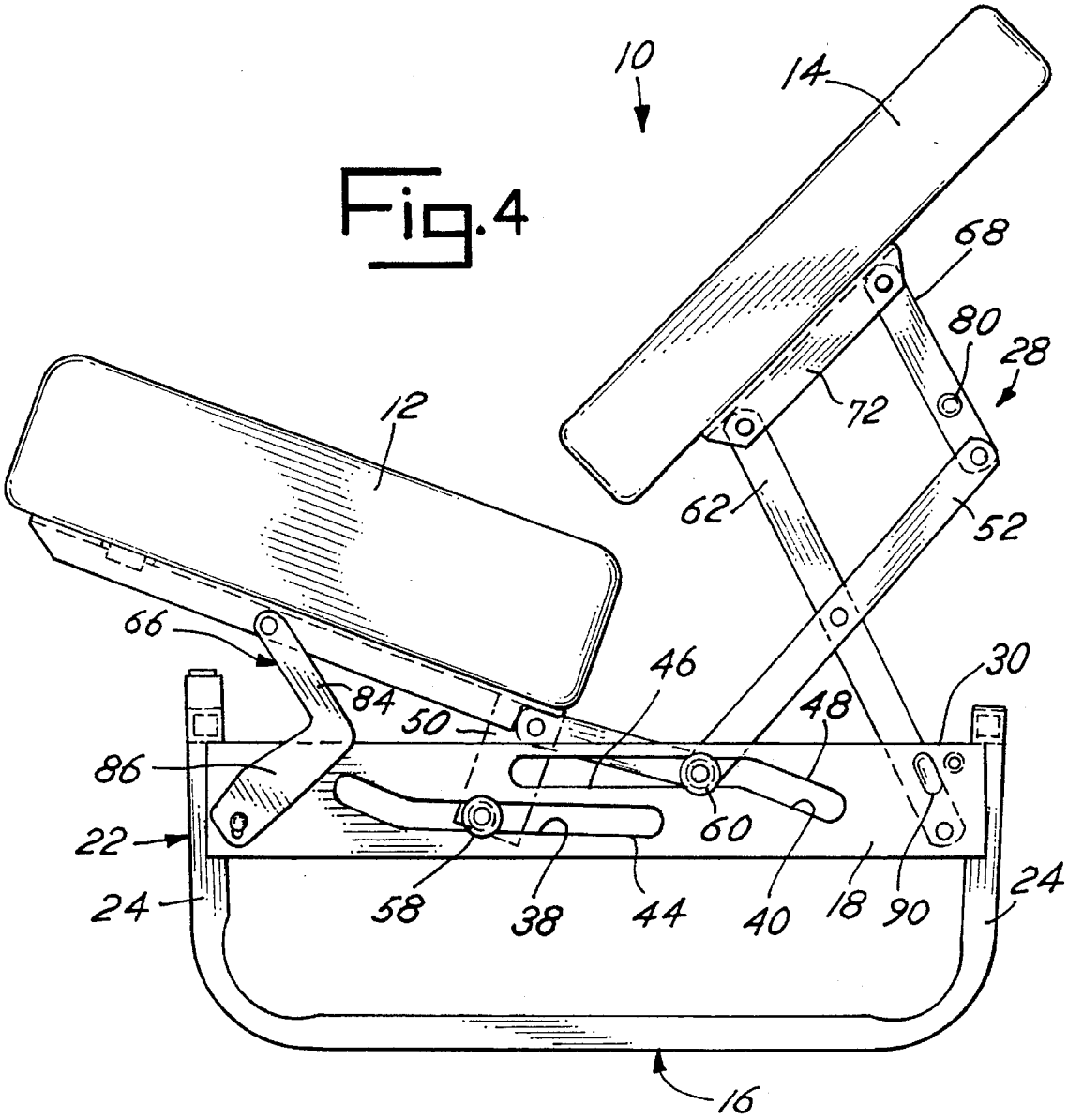
FIG. 4 is a side elevational view of the seat-bed assembly of FIGS. 1 and 2 in an interim position between the seat position and the bed position.
Figure 5:
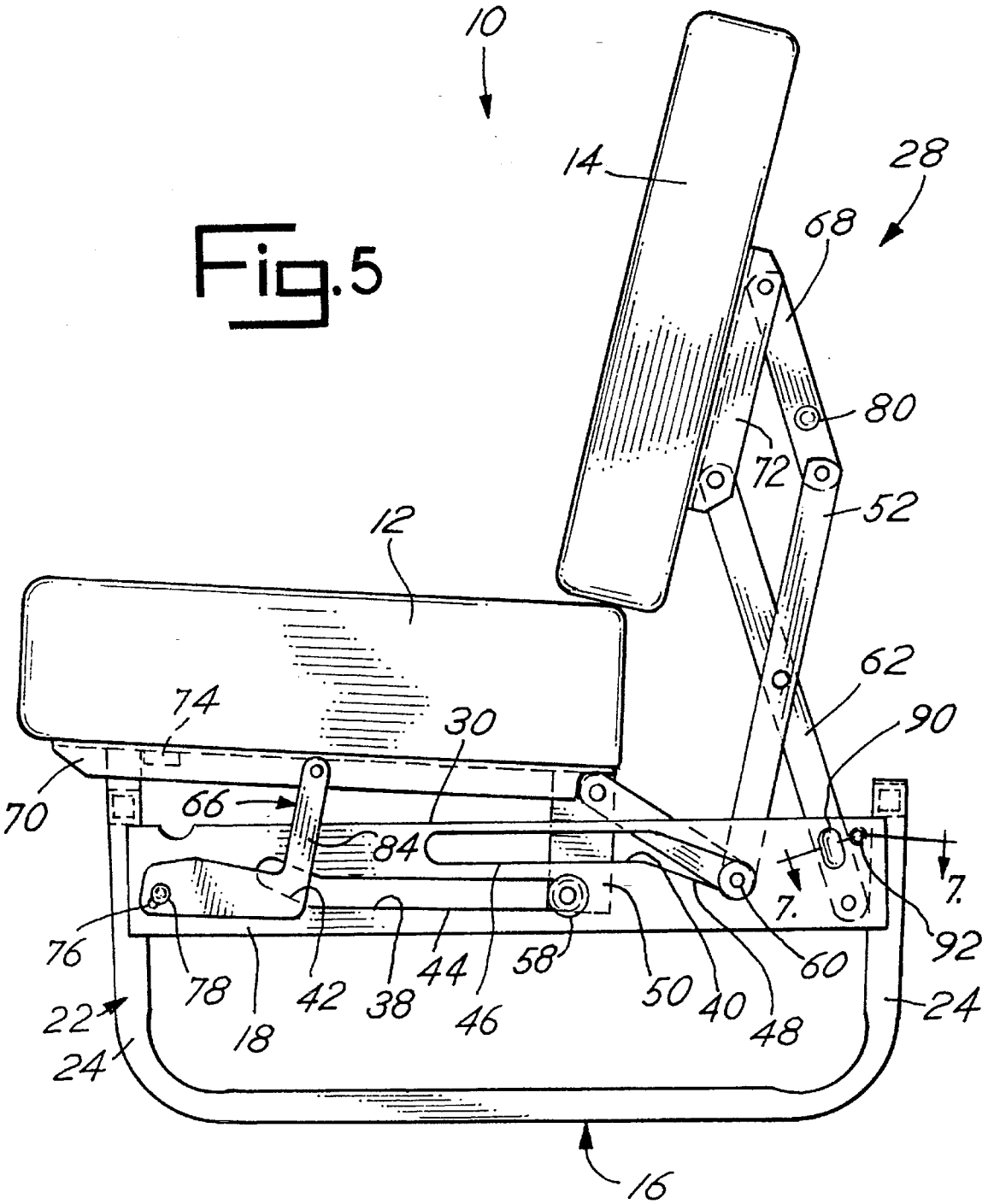
FIG. 5 is a side elevational view of the seat-bed assembly of FIGS. 1 and 2 in the seat position.

FIGS. 3–5 show side views of seat-bed assembly 10. A linkage means 28 is shown in association with horizontal support member 18. It is to be understood, however, that horizontal support member 20 is constructed similar to horizontal support member 18, as described hereinafter, and that a similar linkage means is associated with horizontal support member 20.

Figure 6:
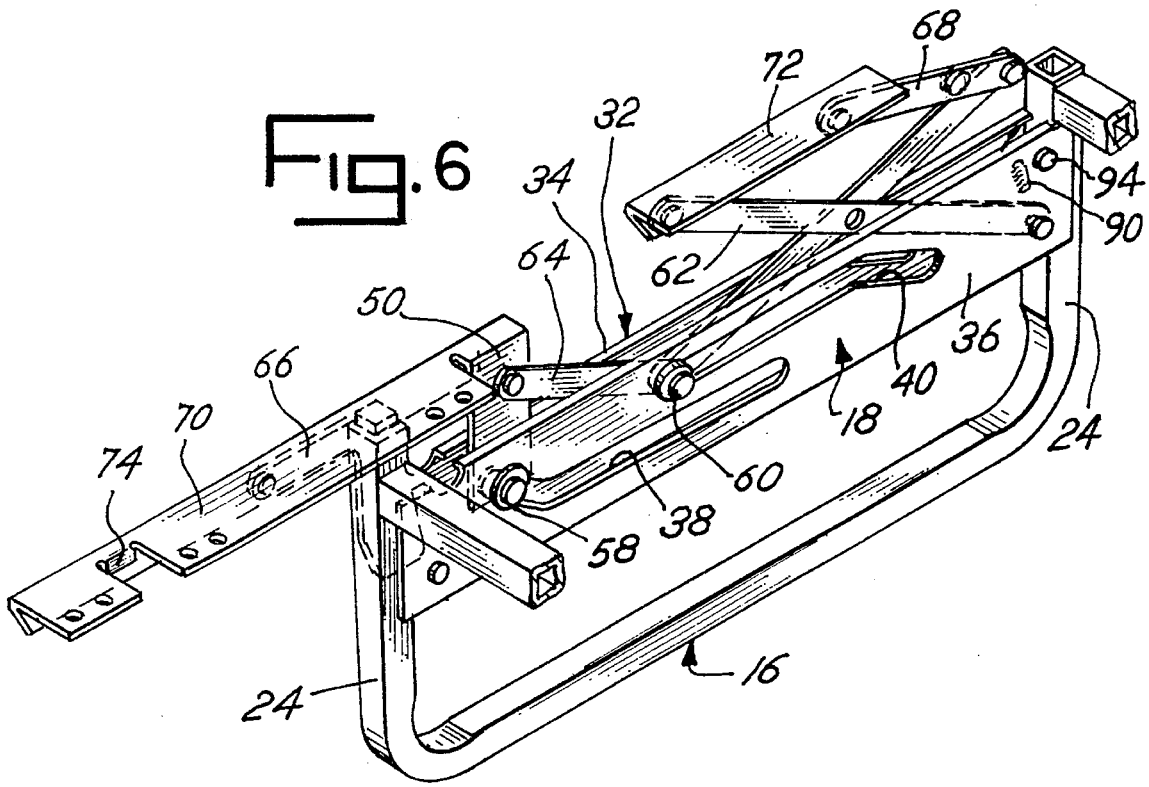
FIG. 6 is a perspective view of an embodiment of the frame assembly of the present invention.
Figure 8:
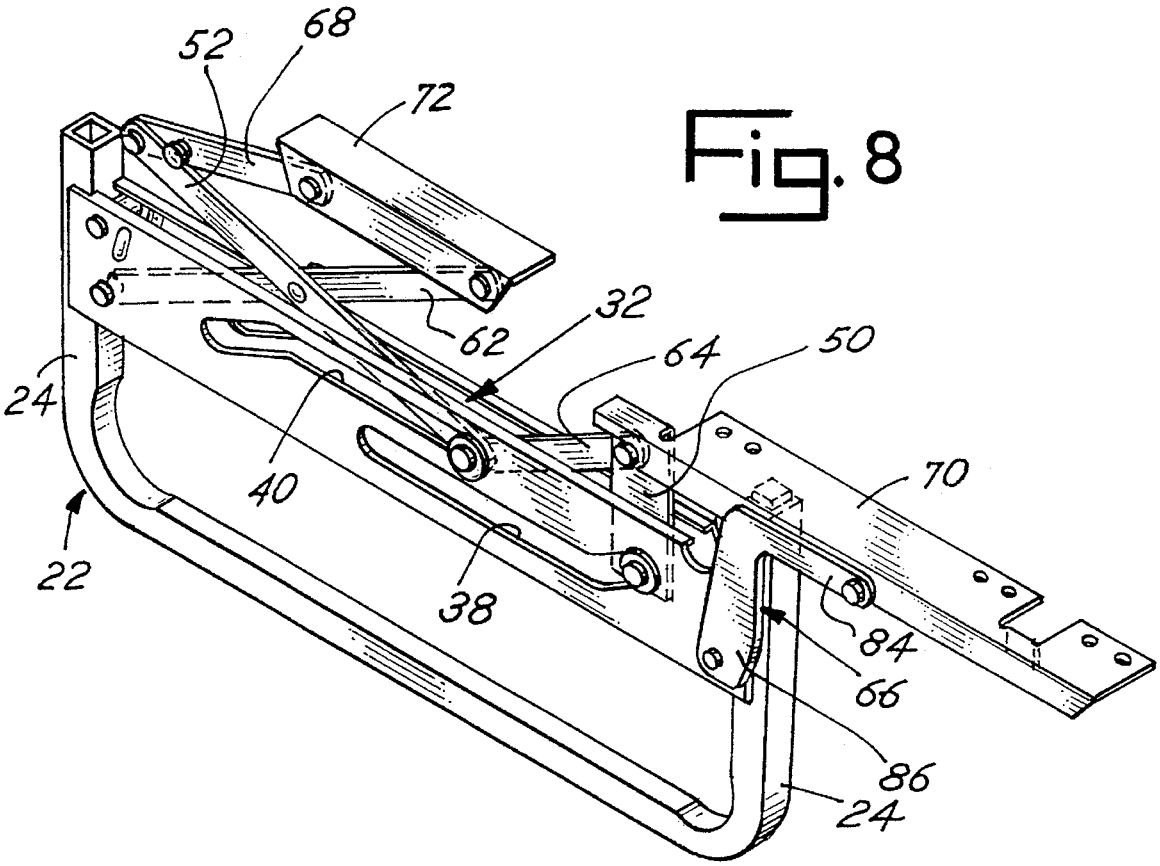
FIG. 8 is a perspective view of the frame assembly of the FIG. 6, viewed from the opposite side.
Figure 9:
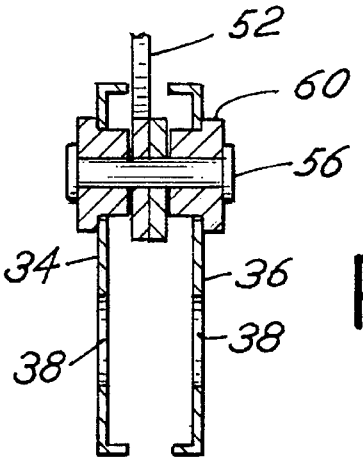
FIG. 9 is a sectional view taken along line 9—9 of FIG. 3.

Horizontal support member 18 has an upper surface 30. Extending downwardly from upper surface 30 is an elongated opening 32 (FIGS. 6 and 8). In the embodiment shown, horizontal support member 18 includes two side plates 34, 36 which define elongated opening 32 therebetween. Side plates 34, 36 each include a first guide channel 38 and a second guide channel 40. Referring to FIGS. 3–5, each of first and second guide channels 38, 40 include two linear portions 42, 44 and 46, 48, described in more detail hereinafter.

Linkage means 28 includes a plurality of links, including a first link 50 and a second link 52 (FIGS. 3 and 5). First link 50 is associated with first guide channel 38, and second link 52 is associated with second guide channel 40. First link 50 and second link 52 each include an opening (not numbered) in one end thereof. Extending through the respective openings are first and second pins 54, 56 which carry a bushing or roller 58, 60, respectively. Bushings 58, 60 are slidably disposed within first and second guide channels 38, 40, respectively. First link 50 is rigidly attached at one end thereof to a seat support 70, while links 64 and 66 are pivotally attached to seat support 70. Links 62 and 68 are pivotally attached at one end thereof to a back support 72. It is apparent from FIGS. 3–5 that linkage means 28 interconnects seat support 70 and back support 72 with frame 16. Moreover, linkage means 28 supports seat support 70 and back support 72 for movement between the seat position (FIG. 5) and the bed position (FIG. 3).

In the embodiment shown, first link 50 is formed as an integral part of seat support 70. However, it is to be understood that first link 50 may be formed separately from seat support 70, and rigidly attached to seat support 70.

Referring now to FIGS. 3, 5 and 6, seat-bed assembly 10 is shown having a locking means which prevents inadvertent movement of the seat-bed assembly from the seat position to the bed position. In particular, the locking means includes a tab 74 formed in seat support 70 (FIG. 6). Referring to FIG. 5, tab 74 engages the surface of vertical support member 22 which faces towards the rear of the seat when the seat-bed assembly is in the seating position. Tab 74 thus prevents forward movement of seat support 70 by engaging vertical support member 22.

To disengage tab 74 and thereby allow movement of seat-bed assembly 10 from the seat position to the bed position, front link 66 includes a slot 76 in which is slidably disposed a pin 78 attached to horizontal support member 18. Slot 76 allows the front edge of seat 12 and seat support 70 to be moved in a vertically upward direction, thereby disengaging tab 74 from vertical support member 22 and allowing seat-bed assembly 10 to move to the bed position.

First guide channel 38 and second guide channel 40 define a means for increasing the relative spacing between adjacent edges of seat support 70 and back support 72 upon initial movement of seat-bed assembly 10 from the seat position to the bed position, and visa versa. To wit, referring first to FIG. 5 showing seat-bed assembly 10 in the seat position, bushing 60 attached to second link 52 is carried within a linear portion 48 of second guide channel 40. Similarly, bushing 58 attached to first link 50 is carried within a linear portion 44 of first guide channel 38. When the front edge of seat 12 and seat support 70 is lifted and moved in a forward direction, first link 50 travels in a horizontally forward direction. Conversely, second link 52 travels in both a forward and upward direction because of the inclined orientation of linear portion 48. The upward component of movement thus causes an increase in a relative spacing between adjacent edges of seat 12 and back 14, i.e., an increase in spacing between the top, rear of seat 12 and the bottom of back 14, as shown in FIG. 4. First and second guide channels 38, 40 are thus structured and arranged to prevent binding interference between seat 12 and back 14 upon initial movement of seat-bed assembly 10 from the seat position to the bed position.

Referring now to FIG. 3, first guide channel 38 includes a linear portion 42 which provides an increasing relative spacing between adjacent edges of seat 12 and back 13 upon initial movement of seat-bed assembly 10 from the bed position to a seat position. To wit, upon initial movement of seat-bed assembly 10 from the bed position to the seat position, bushing 60 connected to second link 52 travels in a horizontally rearward direction. On the other hand, however, bushing 58, connected to first link 50, travels in both a rearward and downward direction. The downward travel of bushing 58 within linear portion 42 of first guide channel 38 causes an increase in the relative spacing between adjacent edges of seat 12 and back 14. The increased relative spacing prevents binding between seat 12 and back 14 upon initial movement of seat-bed assembly 10 from the bed position to the seat position.

Linkage means 28 also includes a means for supporting back support 72 spacedly above frame 16 when seat-bed assembly 10 is in the bed position (FIG. 3), thereby preventing a lower surface of back support 72 and/or back 14 from contacting an upper surface of frame 16. Such contact, e.g., between back 14 and frame 16, may cause damage to the upholstery of back 14. More particularly, as shown in FIGS. 3–5, link 68 includes a laterally extending projection 80 attached thereto. When seat-bed assembly 10 is in the bed position, as shown in FIG. 3, projection 80 engages second link 52 and prevents further scissoring movement between second link 52 and link 68. Projection 80 thus prevents contact between back 14 and frame 16 which would result in damage to the upholstery to back 14.

Referring now to FIGS. 3–5, 7 and 8, frame 16 includes a means 90 which engages one of the links of linkage means 28 when seat-bed assembly 10 is in the seat position for restricting transverse movement of back support 72 in a direction along the width of seat-bed assembly 10. In the embodiment shown, link 62 is engaged and the engaging means which comprises an indentation 90 formed in at least one of side plates 34, 36 of horizontal support member 18. When seat-bed assembly 10 is in the seat position, as shown in FIG. 5, indentation 90 engages link 62, and thereby restricts transverse movement of back support 72 in a direction corresponding to the width of seat-bed assembly 10.

Figure 7:
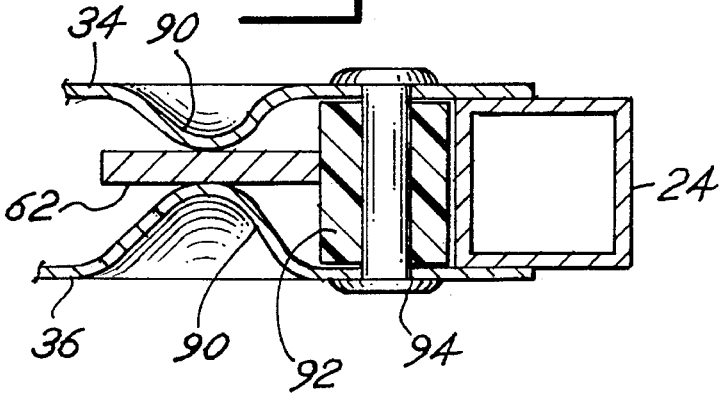
FIG. 7 is a fragmentary sectional view taken along line 7—7 in FIG. 5.

FIG. 7 illustrates an indentation 90 formed in each of respective side plates 34, 36 of horizontal support member 18. Indentations 90 engage each side of link 62 when seat-bed assembly 10 is in the seat position.

Finally, referring to FIGS. 5 and 7, horizontal support member 18 includes a bushing 92 carried by a pin 94 extending through side plates 34, 36. Bushing 92 engages link 62 when seat-bed assembly 10 is in the seat position (FIG. 5), and thereby provides a positive stop and prevents further rearward movement of back 14.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A seat-bed assembly movable between a seat position and a bed position, said seat-bed assembly comprising:

a seat support;

a back support;

a frame including a horizontal support member having an upper surface; and linkage means, interconnecting said seat support and said back support with said frame, for supporting said seat support and said back support for movement between the seat position and the bed position, said linkage means including a plurality of links;

said horizontal support member including an elongated opening extending downwardly from said upper surface, at least one of said links having one end thereof disposed in said elongated opening and slidable along a longitudinal axis of said elongated opening.

2. The seat-bed assembly of claim 1, wherein said horizontal support member comprises two side plates, and wherein said linkage means includes a first link and a second link, each of said first link and said second link having one end thereof with an opening therein, each said side plate having a first guide channel associated with said first link and a second guide channel associated with said second link, and further comprising a first pin extending through said first link opening and each said first guide channel, and a second pin extending through said second link opening and each said second guide channel.

3. The seat-bed assembly of claim 2, wherein at least one of said links includes a slotted opening, said slotted opening receiving a pin, said pin connected at one end thereof to one of said seat support and said horizontal support member.

4. The seat-bed assembly of claim 1, wherein said frame further comprises at least two vertical support members, said horizontal support member interconnecting said vertical support members.

5. The seat-bed assembly of claim 1, wherein one of said seat support and said frame includes a locking means which interacts with the other of said seat support and said frame, said locking means preventing inadvertent movement of said seat-bed assembly from the seat position to the bed position.

6. The seat-bed assembly of claim 5, wherein said seat support includes said locking means, said locking means comprising a tab extending outwardly from said seat support, said tab engageable with said frame when said seat-bed assembly is disposed in the seat position.

7. A seat-bed assembly movable between a seat position and a bed position, said seat-bed assembly comprising:

a seat support;

a back support;

a frame defining a generally vertical front surface; and linkage means, interconnecting said seat support and said back support with said frame, for supporting said seat support and said back support for movement between the seat position and the bed position, said linkage means including a front link connected at opposite ends thereof to said seat support and said frame, said front link having a generally angular profile in which a part of the front link parallels the seat support and another part of the front like is recessed relative to said frame front surface when said seat-bed assembly is in said bed position.

8. The seat-bed assembly of claim 7, wherein said front link includes two substantially linear portions disposed at an angle to each other.

9. The seat-bed assembly of claim 8, wherein said angle is 90°.

10. A seat-bed assembly movable between a seat position and a bed position, said seat-bed assembly comprising:

a seat support;

a back support;

a frame; and linkage means, interconnecting said seat support and said back support with said frame, for supporting said seat support and said back support for movement between the seat position and the bed position, said linkage means including a plurality of links;

said frame including means engaging one of said links when said seat-bed assembly is in said seat position for restricting transverse movement of said back support in a direction along the width of said seat-bed assembly.

11. The seat-bed assembly of claim 10, wherein said frame comprises two side plates disposed in spaced apart, parallel relationship to each other, said side plates defining an elongated opening therebetween, at least one of said links having one end thereof disposed in said elongated opening and slidable along a longitudinal axis of said elongated opening, said frame means including a portion of at least one of said side plates extending into said elongated opening to slidably contact a side of said one link.

12. The seat-bed assembly of claim 11, wherein said frame includes a positive stop means engaging one of said links when said seat-bed assembly is in said seat position for preventing further movement of said back surface relative to said frame.

13. The seat-bed assembly of claim 12, wherein said positive stop comprises a nylon bushing disposed between said side plates.

14. A seat-bed assembly including a seat and back and movable between a seat position and a bed position, said seat-bed assembly comprising:

a seat support;

a back support;

a frame; and linkage means, interconnecting said seat support and said back support with said frame, for supporting said seat support and said back support for movement between the seat position and the bed position, said linkage means further including means for supporting said back support spacedly above said frame when the seat and back support are in said bed position for preventing a lower surface of one of said back support and back from contacting an upper surface of said frame, said linkage means including a rear link and a slidable link, said rear link being pivotally connected to said back support at one end thereof and pivotally connected to one end of said slidable link at an other end thereof, said slidable link at the opposite end thereof being connected to said frame for movement in a generally horizontal direction, one of said rear link and said slidable link including a transverse projection, said projection member constituting said support means for engaging the other of said rear and said slidable link when the seat and back supports are in said bed position.

* * * * *